United States Patent [19]

Funck

[11] Patent Number: 4,628,559

[45] Date of Patent: Dec. 16, 1986

[54] BONDING PRESS FOR SHOES

[76] Inventor: Herbert Funck, Am Wasserbogen 43, 8032 Graefelfing-Lochham, Fed. Rep. of Germany

[21] Appl. No.: 662,342

[22] Filed: Oct. 18, 1984

[30] Foreign Application Priority Data

Oct. 25, 1983 [DE] Fed. Rep. of Germany ..... 3338731
Sep. 11, 1984 [EP] European Pat. Off. ..... 84110816.0

[51] Int. Cl.[4] ..... A43D 25/07; A43D 25/06; B30B 5/02; A44B 21/00

[52] U.S. Cl. ..... 12/33; 12/38; 24/463; 100/272

[58] Field of Search ..... 12/33, 38, 142 T, 142 RS; 100/211, 272, 295, 281, 286; 24/463; 292/246, 144, 252

[56] References Cited

U.S. PATENT DOCUMENTS

| | | | |
|---|---|---|---|
| 75,015 | 3/1868 | Holbrook | 100/286 |
| 851,323 | 4/1907 | Sklovsky | 100/272 |
| 1,181,083 | 4/1916 | Moore | 12/33 |
| 1,337,532 | 4/1920 | Stuart | 12/33 |
| 1,487,178 | 3/1924 | Polleys | 12/33 |
| 1,494,706 | 5/1924 | Polleys | 12/33 |
| 1,793,409 | 2/1931 | Laganas | 12/33 |
| 2,018,172 | 10/1935 | Johnson | 100/272 |
| 2,298,852 | 10/1942 | Ward | 100/272 |
| 2,444,331 | 6/1948 | Bravner | 12/38 |
| 2,996,739 | 8/1961 | Vdolek | 12/33 |
| 3,624,761 | 11/1971 | Kohn | 292/144 |
| 3,791,191 | 2/1974 | Baldyga | 100/272 |
| 3,837,965 | 9/1974 | Malton et al. | 100/211 |
| 4,093,176 | 6/1978 | Contastin | 24/463 |

FOREIGN PATENT DOCUMENTS

| | | | |
|---|---|---|---|
| 2503381 | 10/1977 | Fed. Rep. of Germany . | |
| 2548943 | 2/1978 | Fed. Rep. of Germany . | |
| 1232880 | 10/1960 | France . | |
| 2525877 | 11/1983 | France | 12/38 |
| 433474 | 4/1948 | Italy | 292/252 |

*Primary Examiner*—Werner H. Schroeder
*Assistant Examiner*—Steven N. Meyers
*Attorney, Agent, or Firm*—Weingarten, Schurgin, Gagnebin & Hayes

[57] ABSTRACT

The subject matter of the invention is a bonding press for bonding shoe soles to lasted uppers, comprising a fixed bed structure (1) including an exchangeable receptacle plate (6, 9) into the padded opening (8) of which a lasted upper (7) is inserted and fixed with the sole laid thereon and facing upwards, further comprising a pressing pad (2) to which a pressurized medium may be applied, the dimensionally stable cowl (10) of said pad being hingedly joined to the bed structure (1) and hermetically sealed towards the bottom by a flexibly expandable diaphragm (12), and comprising linear drive means (3) mounted to the bed structure for pivoting the cowl (10) and for producing the closing force. In order to achieve secure fixing of the pressing pad (2) in the closed position thereof with relatively small driving forces and to prevent undesirable opening and closing movements of the pressing pad in the event of failure or breakage of single structural parts, the invention provides that the linear drive means (3) engage with the cowl (10) through an articulated lever mechanism including two toggle levers (17, 21), wherein the relative distribution of weight of the cowl and of the articulated lever mechanism is matched in such a way that there is a weight counterbalance in any open position of the cowl (10). In addition, an automatically operative safety means against upward pivoting of the cowl (10) due to internal pressure may be provided.

13 Claims, 7 Drawing Figures

BONDING PRESS FOR SHOES

The invention relates to a bonding press for bonding shoe soles to lasted uppers, comprising a fixed bed structure including an exchangeable receptacle plate into the padded opening of which a lasted upper is inserted and fixed with the sole laid thereon and facing upwards, further comprising a pressing pad to which a pressurized medium may be applied, the dimensionally stable cowl of said pad being hingedly joined to the bed structure and hermetically sealed towards the bottom by a flexibly expandable diaphragm, and comprising linear drive means for pivoting the pressing pad and pivotally joined to the bed structure.

The DE-PS No. 2,503,381 shows such a bonding press for footwear, in which the pressing pad consists of a stable metal cowl and an expandable diaphragm hermetically secured to the lower flange thereof. The rear end portion of the metal cowl is pivotally mounted in the stationary bed structure and is provided in its topmost region with a bearing block where the piston rod of a pneumatic drive cylinder is pivotally connected. The cylinder is pivotally joined to a column extending beyond the pressing pad. To bond a sole to a lasted upper, the latter is inserted together with the sole laid thereon—after application of the adhesive—into a padded opening in a receptacle plate of the bed structure and is fixed in its position by means of the shape of the padded opening which is matched to the upper. When the cowl has been pivoted to the closed position, a pressure is established in the pressing pad for urging the diaphragm against the sole and the adjacent regions of the upper. In this known bonding press, the forces acting on the cowl in opening direction during said bonding operation have to be accommodated by the drive cylinder, which requires oversizing of the drive cylinder and does not cause reliable locking by form-fit. Moreover, there is the risk that upon a pressure drop in the drive system, for instance in case of breakage of the pressurized air line, the heavy solid cowl will suddenly drop from a partially or fully elevated position, thus resulting in possible serious injuries to the operator.

From the FR-PS No. 1,232,880 a bonding press of simple construction for bonding shoe soles to uppers has been known, in which the lasts together with the uppers and the soles disposed thereon are placed on a fixed mandrel and in which the pressing pad, which is formed of a dimensionally stable cowl and an elastic diaphragm, is closed by hand. For securing the cowl during the pressing operation a latch fastening is provided, the latch being secured to a part of the closed receptacle box for the shoe and extending into engagement about a hook integrally formed with the rim of the pressing pad. By pivoting a hand lever, secure locking of the pressing pad cowl with the bottom box is achieved. Due to these manual operations this bonding press structure cannot satisfy the high demands of shoe manufacturers especially with respect to throughput. A bonding press which is similar in this respect is described in the U.S. Pat. No. 2,996,739, wherein the pivoting movement of the pressing pad is caused by a drive cylinder while locking in the closed position, however, is also effected by pivoting and latching of a manual lever.

Finally, from the DE-AS No. 2,548,943 a bonding press for footwear has been known in which the pressing pad is retained stationary on a bed column and when the press is to be opened the bed structure together with the receptacle plate for the uppers is pivoted obliquely forwardly. To this end the receptacle bed is pivoted to at least two parallelogram levers, one of said levers being a bipartite toggle lever and having a hinge eye for the piston rod of a drive cylinder. This known bonding press is highly complex in technical respect and due to its large moving masses is susceptible to failure especially during long-term operation. The throughput is limited because the opening and closing movements have to be kept relatively small so as to prevent the loosely inserted shoes from being displaced in the opening of the receiptacle plate, which would result in defective bonds and thus in an intolerably large number of rejected shoes.

With the various known bonding presses it happens frequently that a resistance caused by the inserted shoe impedes complete closing of the pressing pad and engagement of the latching means, thus resulting in interruptions and defective pressing operations, i.e., rejected shoes.

It is the object of the invention to provide a bonding press for bonding shoe soles to lasted uppers, which press ensures secure locking of the pressing pad in the closed position without an oversized drive cylinder and in which any damage and injuries caused by dropping of the open pressing pad are reliably prevented.

In accordance with the invention the above-mentioned object is solved in that the linear drive means engage the cowl through an articulated lever mechanism including two toggle levers, the articulated lever mechanism being designed such that it offers protection against inadvertent sudden closing of the cowl and, when the cowl is closed and the toggle levers are fully straightened, against upward movement of the cowl due to the internal pressure in the pressing pad.

Therefore, in accordance with the invention the closing and opening motion of the pressing pad and locking thereof against the opening force occurring during pressing are caused by the articulated lever mechanism, wherein the linear drive means need only supply the small forces for opening and closing of the pressing pad, because the forces caused by the pressing pressure are transmitted from the toggle lever mechanism to the bed structure. It is therefore possible to use small and inexpensive pneumatic cylinders as linear drive means. Preferably, during the pressing operation a pressure is maintained in the pneumatic cylinder so as to maintain the toggle levers in their fully straightened position, but this requires only small forces. Consequently, the linear drive means may have significantly smaller dimensions which result in a substantial saving. The articulated lever mechanism according to the invention also eliminates or reduces the risk caused by sudden dropping of the pressing pad to the closed position, e.g. when the piston rod breaks or when there is no pressure. On the whole, therefore, the bonding press according to the invention offers a substantial improvement in safe working conditions as compared to all known press structures.

In practise, it may happen that upon failure of the control unit the drive means starts to open the cowl before the pressure in the pressing pad has dropped to a sufficiently low level. In that case the residual internal pressure abruptly opens the pressing pad, whereupon the rubber. diaphragm expands towards the side of the operator and may be overstretched to such an extent as to burst, thus constituting a risk of accident to the operator. In order to retain, on the one hand, the advantages of a strong counter-fixing of the cowl during the pressing operation and of the automatic weight counterbalance during the opening and closing movements and to prevent, on the other hand, inadvertent opening of the cowl as caused by residual internal pressure in case of malfunctioning or inaccurate control, an advantageous embodiment of the invention is characterized in that a locking device is provided which as an additional safety device retains the cowl in the closed position until the internal pressure in the pressing pad has dropped to zero or to a correspondingly low level.

In accordance with another suitable embodiment of the invention the cowl includes a solid rear portion and a pivot projection both of which represent counterweights to the front part of the cowl during the opening and closing movement. In order to increase this effect, it is possible to have the solid pivot projection pivotally joined to the bed structure beneath the receptacle plate.

In an advantageous further embodiment of the bonding press a reduction of the weight of the pressing pad may be achieved when the cowl consists of a lightweight cover e.g. of light metal and of a solid frame which includes the bearing block for engagement of the articulated lever mechanism and the solid pivot projection. Thereby the weight of the cowl is reduced particularly in the front portion thereof, and the result is a concentration of weight in the rear end portion of the cowl without any reduction of its overall strength. The bearing block and the lower pivot projection form part of the relatively heavy outer steel frame, which absorbs the forces created during opening and closing of the pressing pad and during the bonding operations, so that even with reduced overall weight of the pressing pad sufficient strength is ensured. Upon a change of the types of shoes to be bonded, corresponding diaphragms as well as cover parts having optimum dimensions may be mounted on the steel frame. It is furthermore possible to mount two different diaphragms between the lightweight cover part of the cowl and the steel frame by employing a spacer ring, whereby two separate pressure chambers result which by sequential application of pressure permit perfect bonding of hard rubber and leather soles.

In a suitable embodiment of the invention the periphery of the diaphragm is provided with an upper and a lower annular ring for effective sealing, which rings are pressed in matching annular grooves formed either in the outer steel frame and in the annular flange of the cover or in the intermediate frame, respectively. After unscrewing of the clamping bolts and removal of the cover part the diaphragm may be replaced simply and rapidly. To this end a quick-clamping device is especially suitable, which may be actuated exclusively from the front when the pressing pad is open. The outer steel frame is provided with an external, downwardly open flange having a complementary clamping pad in engagement with the inclined undercut portion thereof. A countersunk bolt passes from below through said clamping pad and is threaded through an elongated slot formed in the underside of the pressing pad frame into a tensioning nut which is accommodated in a milled-out portion formed in the pressing pad frame, said tensioning nut being non-rotatable and transversely movable in said elongated slot. These clamping means are captively distributed with predetermined spacings therebetween along the periphery of the pressing pad.

The additional locking means against inadvertent opening of the cowl due to a residual pressure within the pressing pad may be designed in various ways. Suitably, the articulated lever mechanism comprises a swivel arm pivoted with one end thereof to the bearing block of the cowl and in engagement with one of the toggle levers, the other end of said swivel arm being supported by a stationary abutment when the cowl is closed. At the termination of the cowl closing movement the upper end of said swivel arm is moved beneath the stationary abutment, the two toggle levers being then fully straightened out. When the internal pressure is established in the pressing pad, the cowl performs a very slight opening movement, which results in tight engagement of the upper end of the swivel arm with the abutment, whereby the gap possibly existing between the swivel arm end and the abutment is closed. Thereby the entire opening force of the cowl is transmitted during the pressing operation to the abutment, which is a tie bar secured to the bed structure. It is thereby impossible for the cowl to pivot to the open position even in case of malfunction of the drive system. It is only after the cowl has again reached its lowermost position on account of its dead weight and a decrease of the pressing pressure to about zero that the swivel arm may be moved out of its locking position, whereupon the cowl may be opened.

In an embodiment of the invention which is especially preferred in respect of its height and fail-safe operation, an obliquely upwardly and rearwardly directed column is secured to the front part of the bed structure, said column supporting the abutment for the swivel are and having an extension to which one of the toggle levers of the articulated lever mechanism is pivoted. The linear drive means, which is a pneumatic working cylinder, is pivoted to a column mounted to the bed structure behind the cowl hinge and is only subjected to compression loads during opening and closing of the cowl, thus resulting in a simplified control and improved safety.

A suitable embodiment of the invention, which is advantageous in particular because of its small height, is characterized in that one toggle lever of the articulated lever mechanism is pivoted to the bed structure beneath the receptacle plate and that to the upper end of said toggle lever, which extends beyond the cowl, the second toggle lever engaging the cowl and the linear drive means are pivoted. As an additional safety means for this embodiment a locking device including locking bars or latches is particularly suitable, said locking bars or latches being moved into engagement by the internal pressure in the pressing pad and being disengaged either automatically and/or by spring action when there is no internal pressure.

Various particularly suitable embodiments of the invention will be explained in detail with reference to the drawing, in which FIG. 1 is a partially sectional side view of a bonding press in the open and closed condition;

Figure 1:
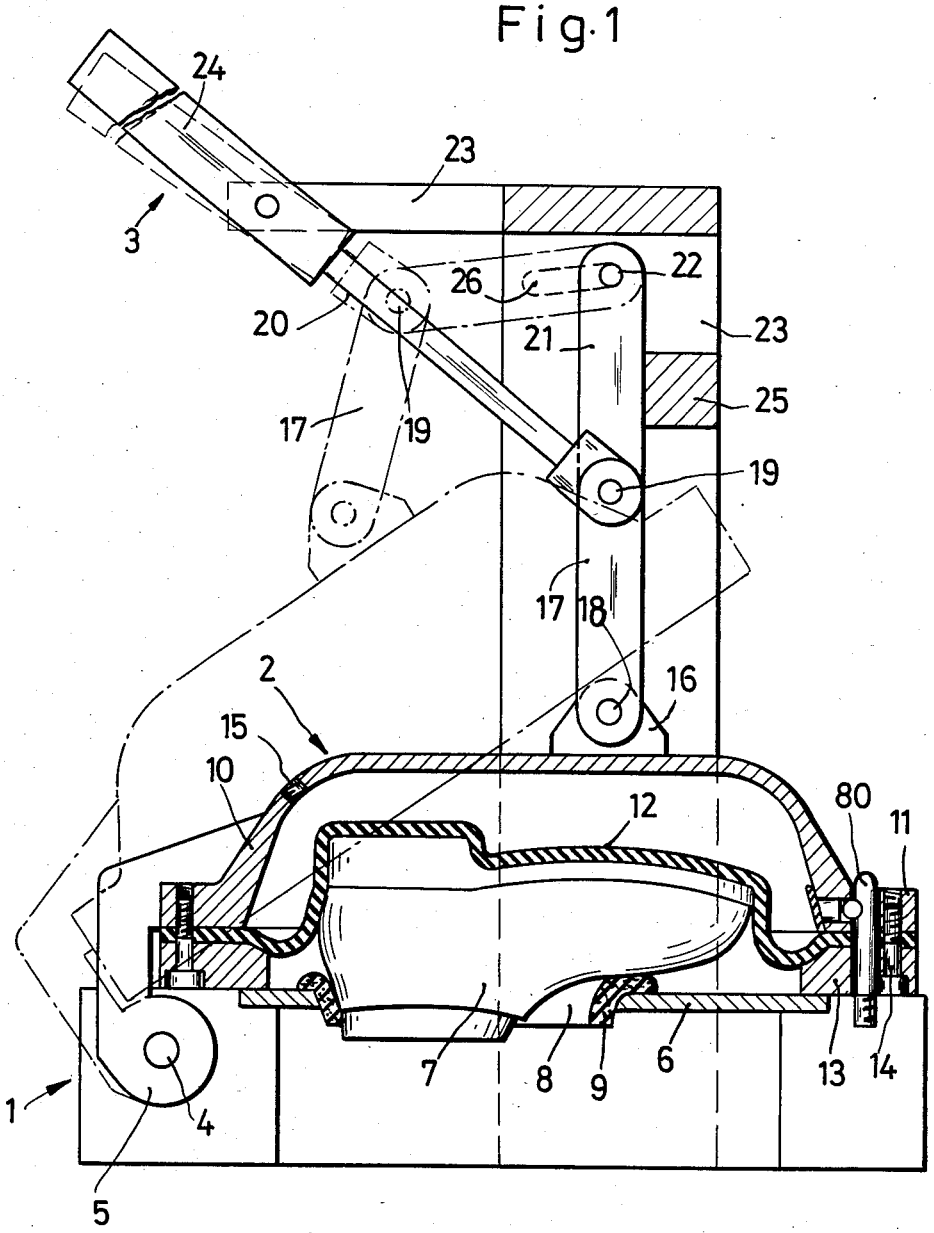

The bonding press illustrated in FIG. 1 comprises a bed structure 1, a pressing pad 2 hinged to the rear end thereof, and a pneumatic-cylinder drive means 3 for pivoting the pressing pad 2 from its closed position shown in full lines to the open position shown in dash-dot lines, and vice versa. In its left-hand portion—as viewed in FIG. 1—the bed structure includes a bearing 4 in which the pressing pad 2 is pivotably supported by means of a downwardly depending solid bearing projection 5. Also, a receptacle plate 6 is releasably secured in the bed structure, said receptacle plate including an opening 8 with a padded rim 9 and said opening being matched to the respective contour of the lasted upper 7. The receptacle plate 6 is disposed above the bearing 4. The top surface of the receptacle plate 6 extends in the closure plane of the pressing pad 2.

The pressing pad 2 comprises a dimensionally stable cowl 10 the left-hand rim of which has the bearing projection 5 integrally formed therewith so as to depend downwardly, and the lower cowl rim of which is shaped like an annular flange 11 and includes a fine-machined surface for engagement with an elastically expandable diaphragm 12. The diaphragm 12 is secured to the annular flange 11 in a pressure-tight manner by means of a clamping ring 13 and bolts 14. A port 15 in the cowl is used for introducing and, respectively, venting the pressure medium, preferably pressurized air, into and from the interior of the pressing pad 2, said interior being hermetically confined by the elastic diaphragm 12 and the cowl 10. A bearing lug 16 is mounted in an upper portion of the cowl 10, to which a toggle lever 17 is pivoted by means of a pivot pin 18. The upper end of said toggle lever 17 is provided with a pivot 19 to which the piston rod 20 of the drive means 3 and the lower end of a second toggle lever 21 are pivotally joined.

The upper end of said upper toggle lever 21 is secured for travelling motion to a pivot pin 22 mounted in a column 23 which forms part of the rigid bed structure. The cylinder housing 24 of the drive means 3 is hingedly mounted to a horizontal bracket of the column 23. Furthermore, the column 23 on its vertical portion carries a stop member 25 for limiting the pivoting movement of the toggle lever 21 in a position in which the two toggle levers 17 and 21 are aligned along an axis and thus are in their locking position. Due to the bearing projection 5 integrally formed with the cowl 10, a pivoting axis for the pressing pad 2 is formed which lies at the bed structure 1 beneath the receptacle plate 6. This results in especially advantageous kinematics during opening and closing of the pressing pad 2 by means of the drive means 3 via the toggle lever mechanism 17, 21 as well as in an effective weight counterbalance during opening and closing of the cowl 10. As illustrated in dashed lines, the pivot pin 22 may be accommodated in an elongated slot 26 formed in the column 23 for transverse movement so as to increase the width of opening of the pressing pad 2 when the drive means is disposed accordingly.

The bonding press described above operates as follows:

When the pressing pad 2 has been opened to the dash-dot line position, a lasted upper 7 together with the sole loosely placed thereon is manually or otherwise inserted in the padded opening 8 of the receptacle plate 6 such that the sole surface faces towards the top. By application of e.g. compressed air to the drive means 3 the pressing pad 2 is pivoted about its bearing 4 with increasing force into the illustrated closed position, in which both toggle levers 17 and 21 are straightened out, the upper toggle lever 21 being supported by the fixed stop member 25 of the column 23. Due to this coaxial alignment of the two toggle levers 17, 21 the pressing pad is securely locked in its closed position. During the closing phase the flexible diaphragm has moved into engagement with the sole surface. Upon introduction of compressed air into the inner space confined by the cowl 10 and the flexible diaphragm 12 the diaphragm will be urged against the running surface of the sole, the sole edges and portions of the upper, whereby the adhesive previously applied to the sole and the upper is activated.

Figure 2:
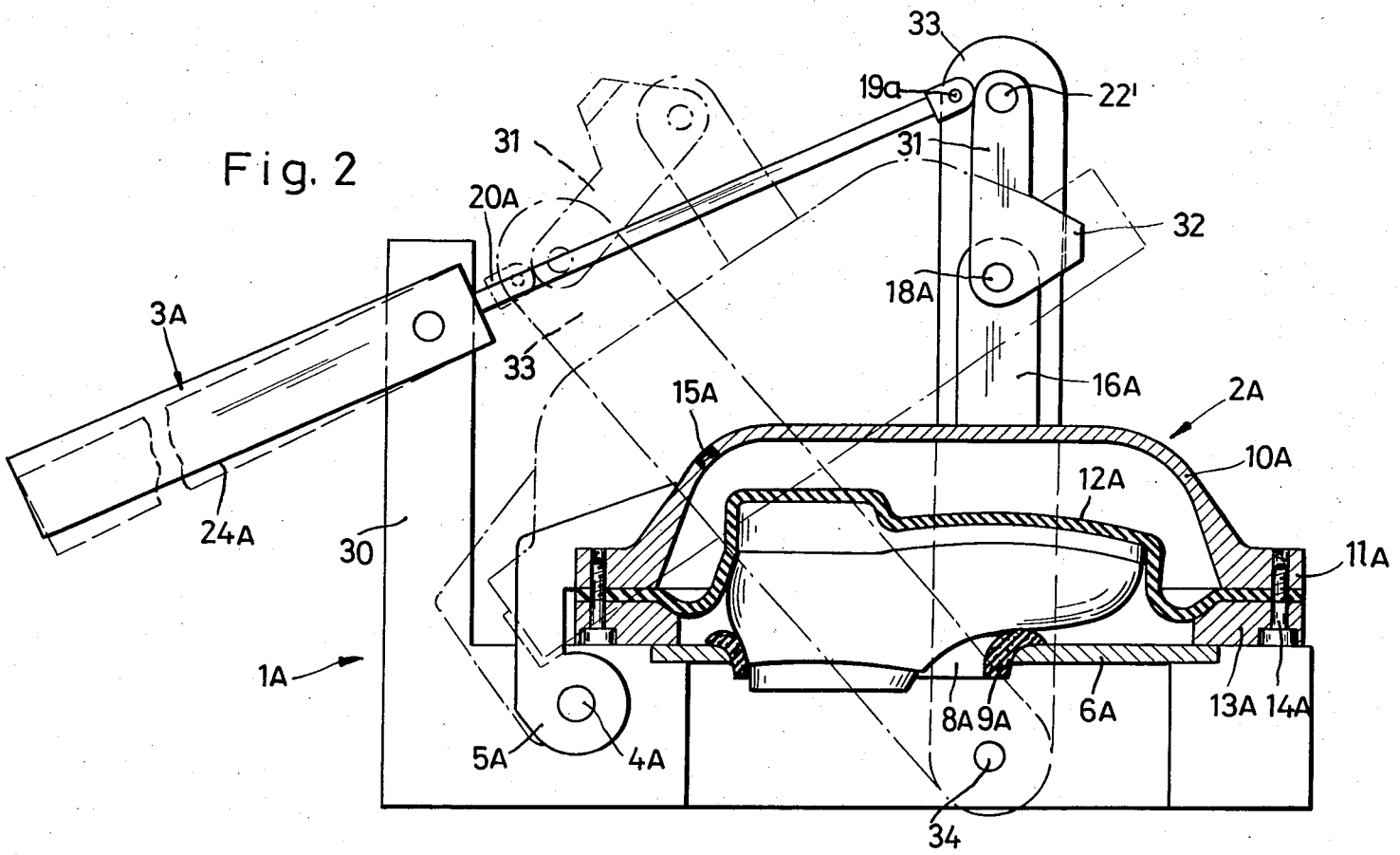
FIG. 2 is another embodiment of the bonding press including a toggle lever articulated to the bed structure beneath the pressing pad, as illustrated in FIG. 1.

The bonding press shown in FIG. 2 also comprises a bed structure 1, a pressing pad 2 and drive means 3 and differs from the embodiment illustrated in FIG. 1 substantially by its reduced height. (In subsequent figures, parts similar to those of previous figures have been given the same reference numerals, but with a subsequent letter designation, and will not be described again.)

As shown in FIG. 2, a vertical column 30 is secured to the rear end of the bed structure 1A to which the cylinder housing 24A of the drive means 3A is hingedly joined. The bottom end of a first toggle lever 31 is pivoted via the pivot pin 18A to the extended lug 16A mounted on the cowl 10A and is provided with a stop boss 32. The upper end of said first toggle lever 31 is pivoted via a pivot bearing 22' to the upper end of the second toggle lever 33 whose lower end portion is pivotable about a pivot pin 34 in the bed structure 1A beneath the receptacle plate 6A. The piston rod 20A of the drive means 3A is in pivotal engagement with the upper end of said second toggle lever 33 at 19*a*. The longer toggle lever 33 consists of two parallel members hingedly mounted on either side of the pressing pad 2A to the bed structure 1A vertically beneath the receptacle plate along the centre line of the lug 16A—when the pressing pad is closed—and the upper ends of said members are joined by a solid transverse member which simultaneously forms the pivot bearing 22' for the first, upper toggle lever 31. The positions of the toggle levers 31, 33 and the bearing lug 16A provided on the cowl 10A are matched to each other such that their centre lines coincide when the pressing pad 2A is closed and extend approximately vertically. This arrangement automatically results in effective locking of the pressing pad in the closed position thereof, wherein this locked position is achieved by engagement of the stop boss 32 formed on the toggle lever 31 against the abutment on the toggle lever 33 and—provided the respective lengths of the two toggle levers 31 and 33 and of the lug 16A are suitably chosen—in an additional closing force applied to the pressing pad in said locked position. The two members of the toggle lever 33, which extend upwardly beyond the closed pressing pad 2A, will then act as tie rods which introduce the closing forces into the substructure of the bed structure. Position and height of the column 30 are selected to obtain a maximum opening width of the pressing pad so that the uppers may freely be disposed in and removed from the opening 8A of the receptacle plate 6A, respectively. As will be apparent, in this embodiment the part of the cowl between the bearing projection 5 and the bearing lug 16A also acts as a swivel arm which is integrated in the toggle mechanism, wherein, when the cowl is either partially or fully open, there is a counterbalance of weight and forces which reduces the risk of inadvertent closing of the pressing pad upon failure of the pneumatic system. For the rest, the operation of this bonding press corresponds to that of the embodiment illustrated in FIG. 1.

Figure 3:
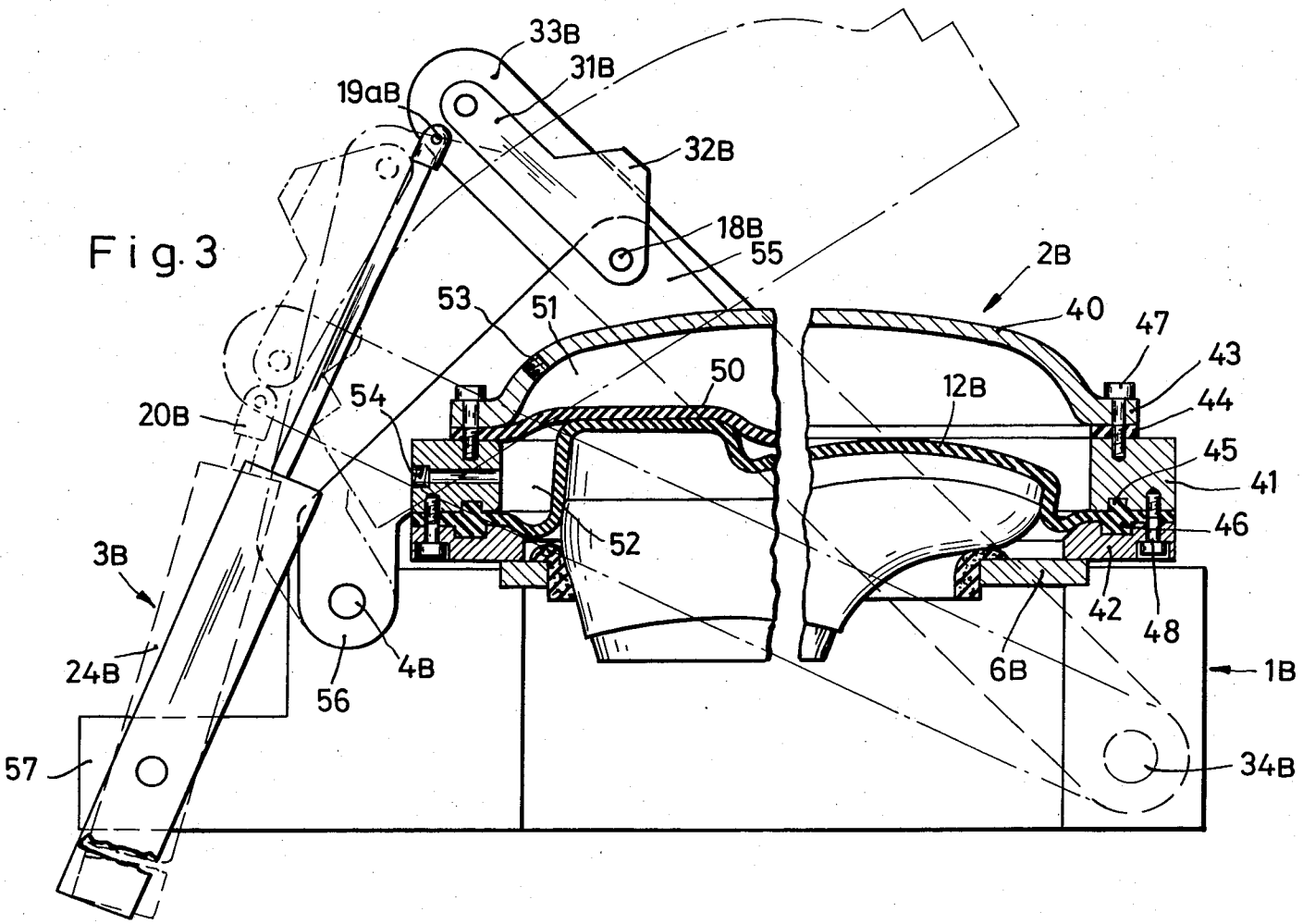
FIG. 3 is a further embodiment of the bonding press including an inclined toggle lever articulated to the bed structure beneath the pressing pad, as illustrated in FIG. 1.

The bonding press shown in FIG. 3 comprises a swivel lever system which is similar to that of the embodiment shown in FIG. 2 and differs therefrom essentially by the improved automatic compensation of the weight of the pressing pad and by a specific design of the cowl. So as to achieve a practically complete weight counterbalance, the cowl 10B is made of two parts, i.e. an inner cover part 40 of a light-weight material such as cast aluminium or a fibre-reinforced plastics, and a frame part including a steel frame 41, a lower clamping frame 42 and clamping means. As shown in the right-hand portion of FIG. 3, the cover part 40 is bolted by means of its outer annular flange 43 to the upper steel frame 41 with a gasket 44 interposed therebetween. Each frame 41, 42 is provided with an annular groove 45, 46 in the engaging surface thereof into which an upper and, respectively, lower annular ring is fitted at the periphery of the flexible diaphragm 12B. Bolts 47, 48 serve as clamping means for securing the light-weight cover 40 to the steel frame 41 and for hermetically fastening the diaphragm rim between the clamping frame 41 and the steel frame 42.

This especially suitable embodiment of the cowl 10B results in a substantially reduced weight of the pressing pad, on the one hand, and on the other hand offers the possibility of using an additional diaphragm 50 on top of the diaphragm 12B, which is made of a flexible material, normally leather, that cannot be expanded at least in longitudinal direction (see the left part of the pressing pad 2B of FIG. 3). Said diaphragm 50 may be hermetically clamped instead of the gasket 44 between the rim flange 43 of the cover part 40 and the upper annular element 41 and partitions the pressing pad space into an upper and a lower hermetically sealed chamber 51 and 52, respectively, to which pressurized medium is applied through separate ports 53 and 54, respectively. When the clamping bolts 47 are unscrewed the gasket 44 may easily be replaced by the leather diaphragm 50, which is preferably used for bonding stiff leather or rubber soles so that pressure is applied to said soles only from the top and any displacement during the closing movement of the pressing pad 2B is prevented. To this end the height of the steel frame 41 is advantageously selected such that the diaphragm 50 is approximately in the region of the sole surface before pressure is applied to the pressure chamber 51.

In this embodiment the desired weight counterbalance is achieved, apart from the bipartite structure of the cowl, because the pivots 34B for the long toggle lever 33B are offset in the bed substructure towards the front to approximately beneath the front part of the frames 41, 42 and the length of said toggle lever 33B is increased, so that with the pressing pad 2B closed the lever likewise extends with an upper portion inclined to the rear and beyond the pressing pad. The other toggle lever 31B, which is pivotally mounted at its upper end and includes the nose-like abutment boss 32B, is pivoted with its lower end to the bearing pin 18B of a bearing block 55 rigidly mounted on the steel frame 41. By means of a lower pivoting lug 56 said bearing block 55 is pivotally mounted via the bearing pin 4B to the bed structure and in combination with the levers 31B, 33B forms the toggle mechanism for moving the pressing pad 2B and for locking the same in the closed position thereof. The cylinder housing 24B of the drive means 3B is hingedly connected to a lower horizontal column 57 of the bed structure 1B and extends approximately vertically downwardly, thus resulting in an advantageous saving of side space.

Due to the obliquely forward-downward and rearward-upward arrangement of the toggle lever 33B, the provision of the bearing block 55, and the illustrated arrangement of the drive means 3B the weight of the pressing pad 2B, which is reduced in comparison to conventional presses, is compensated for by the weight of said components, and that at least when the pressing pad is in its open and in its partially closed position. Due to this weight counterbalancing it is possible to use small and therefore inexpensive actuator cylinders as said drive means 3B, because it is merely required to overcome the frictional forces for opening and closing the pressing pad 2B. At the same time the long toggle lever 33B, which is made of two members and one transverse member, again acts as tie rod which during the pressing operation absorbs the opening forces generated by the pressurized medium and introduces the same into the bed structure.

Figure 4:
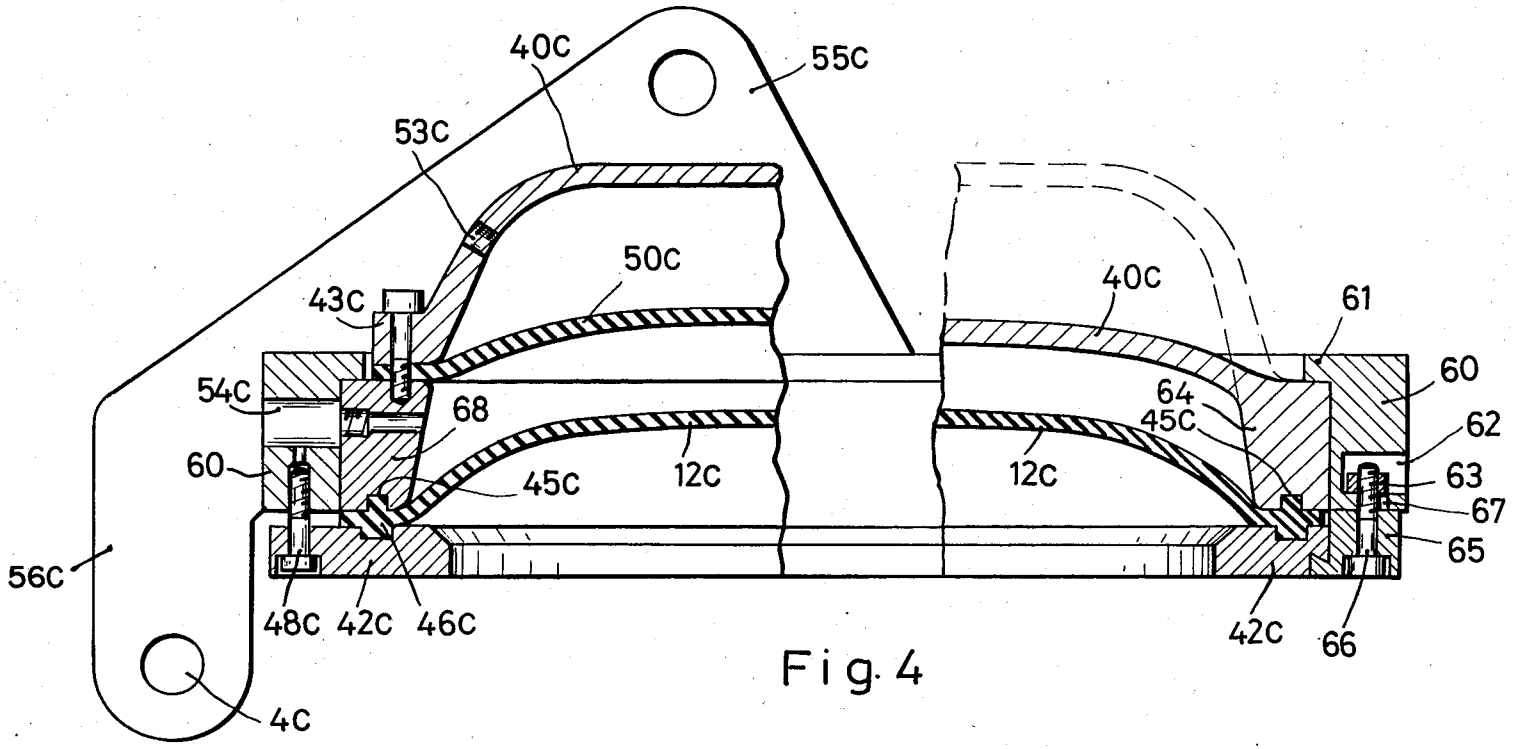
FIG. 4 shows different embodiments of the pressing pad in vertical section.

FIG. 4 is an enlarged view of a pressing pad for bonding presses, in which the left-hand portion of the figure shows two diaphragms 12B and 50B and the right-hand portion is provided only with the flexible diaphragm 12C. In comparison with the embodiment shown in FIG. 3, this pressing pad assembly differs essentially by a suitable quick-clamping device which permits ready exchange of the inner cover parts 40C and also of the respective diaphragm 50C or 12C. As will be apparent, the bearing block 55C is rigidly mounted to a dimensionally stable, relatively heavy steel frame 60 whose upper end is formed with an integral shoulder 61 and whose lower part is provided with radial blind bores 62 for receiving nuts or bolt heads 63. The light-weight cover part 40C made, for instance, of cast aluminium and shown on the right-hand side of FIG. 4 is formed with an enlarged rim 64 having machined in its engaging face the annular groove 45C for receiving the upper annular ring of the flexible diaphragm 12C. Undercut radially outer recesses of the clamping frame 42C have clamping pads 65 seated therein through which clamping bolts 66 with sunk heads extend by means of which the flexible diaphragm 12C is hermetically fastened between the clamping frame 42C and the enlarged rim 64 of the cover part 40C. Tightening of the clamping bolts 66 draws the steel frame 60 towards the clamping frame 42C, while the shoulder 61 is urged against the upper edge of the enlarged cover rim 64, thereby securing hermetical fixing of the cover part 40C and the diaphragm 12C in the pressing pad 2C.

It is also possible to use the same quick-clamping device when two diaphragms 12C, 50C are employed. In that case an intermediate frame 68 is clamped between the lower clamping frame 42C and the horizontal edge 43C of the cover part 40C, the height of the intermediate frame approximately corresponding to the height of the enlarged rim 64 of the cover part 40C shown in the right-hand part of FIG. 4. It is thus possible to employ the same steel frame 60 and the quick-locking device 63–66 for hermetically clamping together the clamping frame 41C and the intermediate frame 68 with the flexible diaphragm 12C interposed therebetween. As shown, it is also possible to use simple threaded bolts 48C for clamping.

A significant advantage of this pressing cover structure resides in the possibility of rapidly and simply matching the pressing pad to different types and sizes of shoes. When the pressing pad is fully opened, all of the clamping bolts 44C and 66, respectively, are accessible from the front of the press and may be either unscrewed or tightened without the operator having to walk around the press, which was required so far and which is inconvenient and requires free space to move in.

When the cover part 40C and/or one of the diaphragms 12C, 50C is to be exchanged, the clamping pad 65 engaging in the undercut recess or groove formed on the clamping frame 42C is loosened by unscrewing of the clamping bolts 66 such that the pad becomes free of the recess or groove and the bolt may be pushed outwardly in a radial elongated slot 67 until the clamping frame 42C and the soft diaphragm together with the inner cover part 40C of the pressing pad 2C may be removed forwardly and downwardly from the steel frame 60.

Preferably, the quick-clamping device includes only about twelve clamping pads 65, so that a rapid diaphragm exchange may be effected. During such exchange the clamping pads 65 cannot get lost, because the clamping bolts 66 remain in their nuts 63. An exchange of the inner cover part 40C is equally simple, so that the pressing pad volume that is to be filled with pressurized medium may rapidly be matched to different shoe sizes. For instance, for children's shoes and for sandals the cover part 40C shown on the right-hand side of FIG. 4 may be used, since it has a substantially reduced height as compared to the normal cover part shown in dashed lines; thereby the consumption of pressurized medium of the press is reduced by about half. It is equally simple to assemble and dissemble the additional non-flexible diaphragm 50C by the use of a correspondingly matched cover part 40C. After unscrewing the clamping bolts 48C and 66, respectively, with the pressing pad in the fully open position, the subassembly comprising the clamping frame 42C, the flexible diaphragm 12C, the intermediate ring 68, the non-flexible diaphragm 50C and the cover part 40C may be removed forwardly and downwardly.

Figure 5:
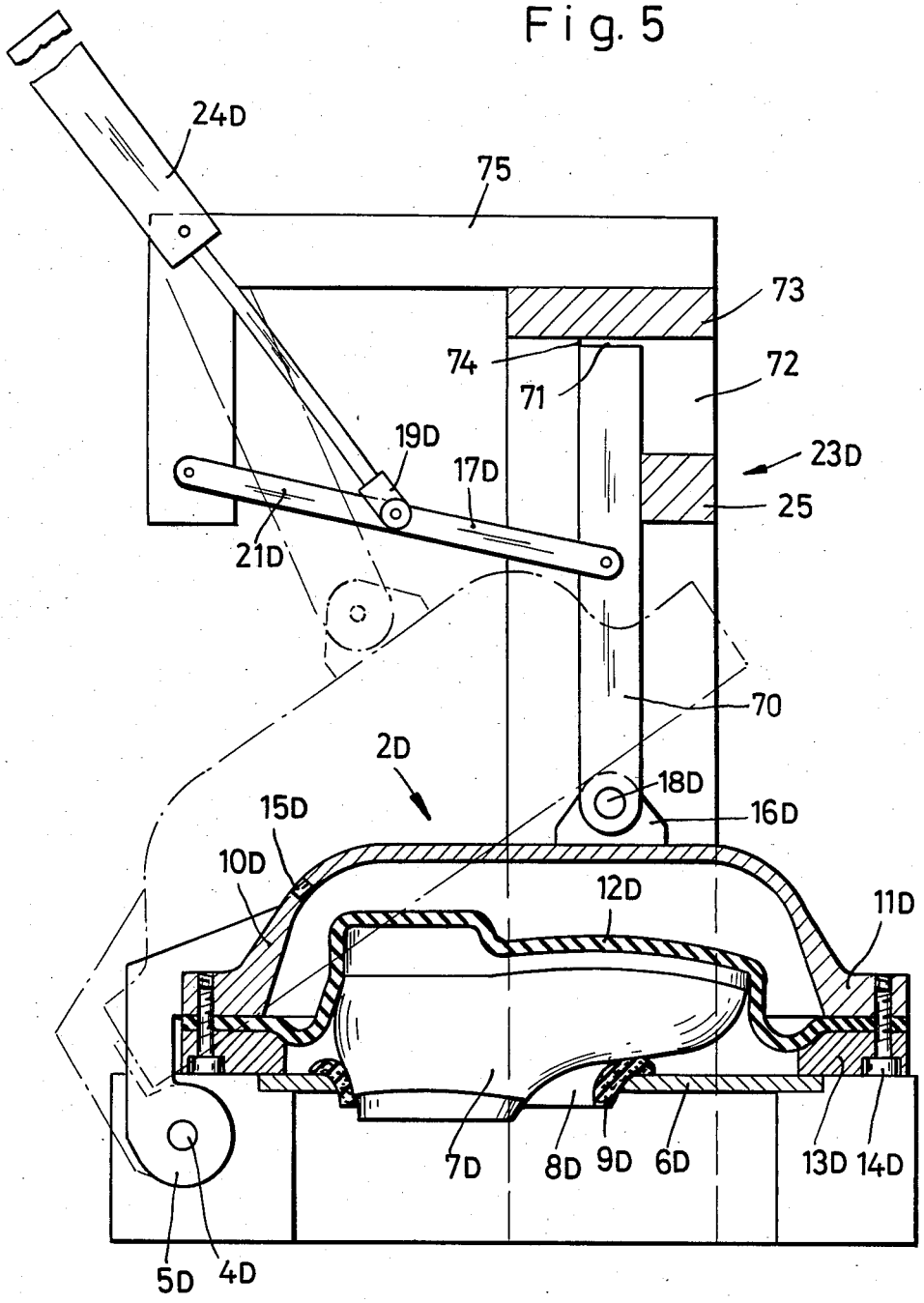
FIG. 5 and FIG. 6 show further embodiments of the bonding pressing in vertical section, comprising an additional safety means against swinging-up.

The embodiment shown in FIG. 5 is similar to the bonding press shown in FIG. 1 especially in respect of the bed structure including the column for the drive means and the pressing pad design. As will be apparent, the articulated lever mechanism is composed of the two toggle levers 17D, 21D and an additional swivel arm 70 to which the toggle lever 17D is pivotally connected approximately intermediate the ends of the swivel arm 70, the lower end of said arm 70 being pivotally connected via the pivot pin 18D to the lug 16D the cowl 10D. The upper end of said swivel arm 70 is provided with a bearing face 71. The supporting column 23D, which is rigidly mounted on the bed structure, comprises two vertical posts 72 joined to each other by an upper tie bar 73. The length of the swivel arm 70 is selected such that in the closed position of the pressing pad 2D, which is shown in FIG. 5 in full lines, a small gap 74 is formed between the upper bearing face 71 of the swivel arm 70 and the lower face of the tie bar 73, said gap permitting movement of the swivel arm 70 beneath the tie bar 73 shortly before termination of the closing movement.

An angled bracket 75 is rigidly mounted to the tie bar 73 or the posts 72 or even direct to the bed structure, the cylinder housing 24D of the drive means 3D and at an appropriate spacing therefrom the toggle lever 21D being pivotally mounted to said bracket 75. The piston rod of the drive means 3D is in engagement with the joint 19D of the two toggle levers 17D, 21D.

This bonding press, which is provided with an additional safety device against upward tilting, operates in a manner similar to that of the press shown in FIG. 1, but differs therefrom by the locking function of the swivel arm 70 when the pressing pad 2D is closed. When the drive means is moved, with the pressing pad in the open position, from the upward position shown in dash-dot lines to the full-line closed position, the extending piston rod has a pushing action on the swivel arm which is initially aligned therewith, whereby the first part of the closing movement is performed relatively quickly. Towards the termination of said closing movement the two toggle levers 17D, 21D are straightened and the swivel arm 70 is pivoted about the pivot bearing 18D into the vertical position beneath the tie bar 73 shown in FIG. 5, whereby the illustrated small gap 74 is formed. When the pressing pad 2D is supplied with pressurized air through the port 15D, the diaphragm will be deformed and come into engagement with the rim portions of the upper. Due to the internal pressure in the pressing pad 2D, the cowl 10D is pivoted upwardly by an extremely small amount until the gap 74 disappears and the upper bearing face 71 of the swivel arm 70 engages the lower face of the tie bar 73. The swivel arm 70 will remain in this position during the entire pressing operation until the internal pressure inside the pressing pad 2D has dropped to approximately atmospheric pressure and the cowl returns to the illustrated lower position due to its dead weight. Thus the upper end of the swivel arm 70 clears the tie bar 73 and the gap 74 is formed again, so that during the retracting movement of the drive piston the swivel arm may be moved from the illustrated position. If because of inappropriate control the drive means 3D is switched to opening before the internal pressure in the pressing pad has dropped to about atmospheric, the friction caused by the pressure of the swivel arm 70 against the tie bar 73 will prevent pivoting of the swivel arm 70 from beneath the tie bar 73, thereby securing the pressing pad against an undesired opening movement. Thereby the advantage of a proper cowl locking by means of the articulated lever mechanism is maintained, on the one hand, and secure locking of the cowl against opening under pressing pressure is ensured, on the other hand. Thus the additional locking function against inadvertent opening of the pressing pad is taken over by the swivel arm 70, whose lower end engages the cowl 10D and whose upper end, which extends beyond the pivot point 22D of the toggle lever 17D, is supported at the upper tie bar 73 with the cowl being closed, as soon and as long there is an internal pressure in the pressing pad 2D. The significant difference of the bonding press of FIG. 5 in constructional and functional respect as compared to the embodiment shown in FIG. 1 therefore resides in the use of a further swivel arm 70 to which the toggle lever 17D is pivoted and which transmits the forces for the opening and closing movement from the drive means 3D to the cowl 10D and in addition has a securing function against inadvertent opening. In this embodiment the two toggle levers 17D, 21D do no longer have a proper locking function but mainly ensure that the swivel arm 70 takes its locking position with the pressing pad being closed. This press embodiment offers an operational advantage insofar as the operator is made aware of a malfunction of the control means, and that without the risk of injuries and/or damage to the press components, as soon as the pressing pad does not automatically move to its open position. This will be the case when the pressing pad is not vented sufficiently quickly or is not vented at all or when the drive means is switched to "open" before the pressing pad pressure has dropped to atmospheric.

Figure 6:
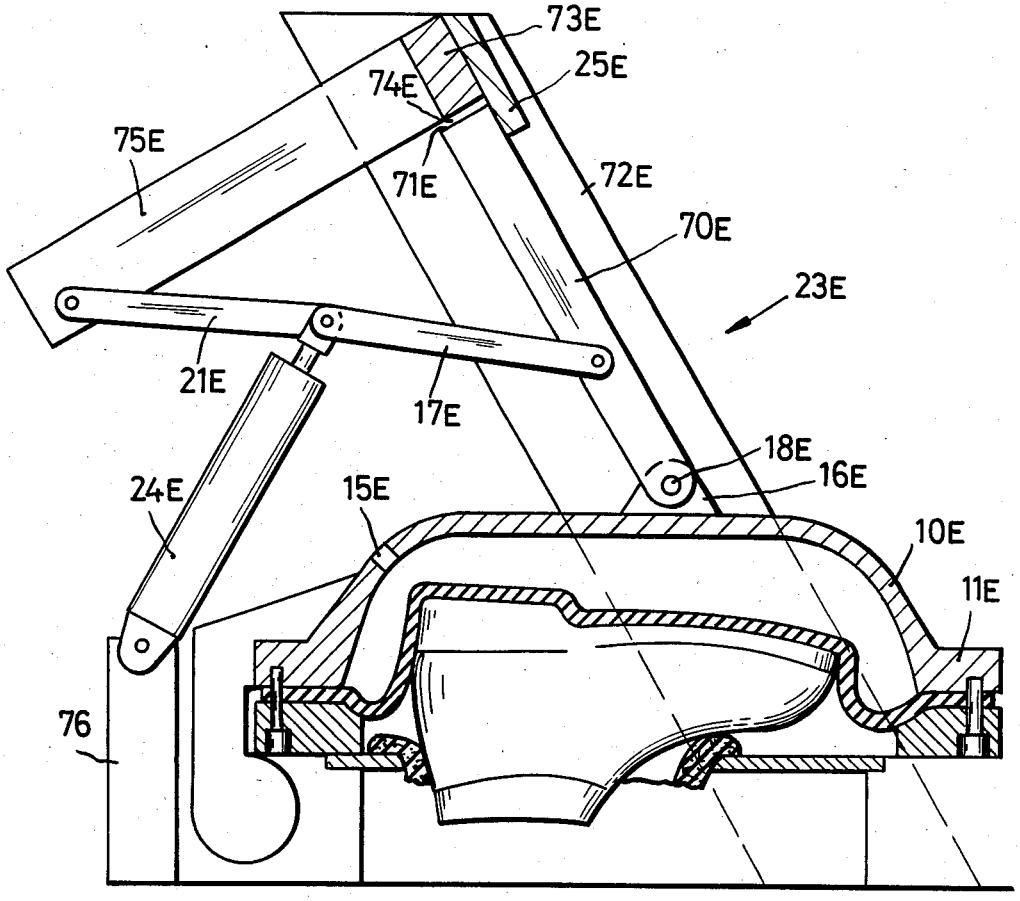

The bonding press illustrated in FIG. 6 substantially corresponds to the embodiment of FIG. 5, in particular with respect to the additional locking device preventing opening of the pressing pad. The two posts 72E of the column 23E, however, are secured to the front right-hand part of the bed structure 1E and extend obliquely upwardly and rearwardly. Furthermore, the drive means 3E is pivoted to a column 76 which—similar to the embodiment of FIG. 3—is mounted laterally behind the cowl bearing 4E directly to the bed structure 1E. With the pressing cowl being closed, the swivel arm 70E extends in parallel with the two posts 72E of the column 23E and with its bearing face 71E engages the tie bar 73E as soon as there is an internal pressure inside the pressing pad. As illustrated, the bracket 75E is inclined and carries at its lower free end the bearing for the toggle lever 21E. The operation of this press corresponds to that of the press of FIG. 5. It is, however, an advantage that the drive means acts from below and that its piston rod and the threaded portion thereof are exclusively subjected to compression loads during the opening and closing movement; a tensile load acts on the piston rod merely towards the end of the closing movement, but only when the cowl already rests on the bed.

Figure 7:
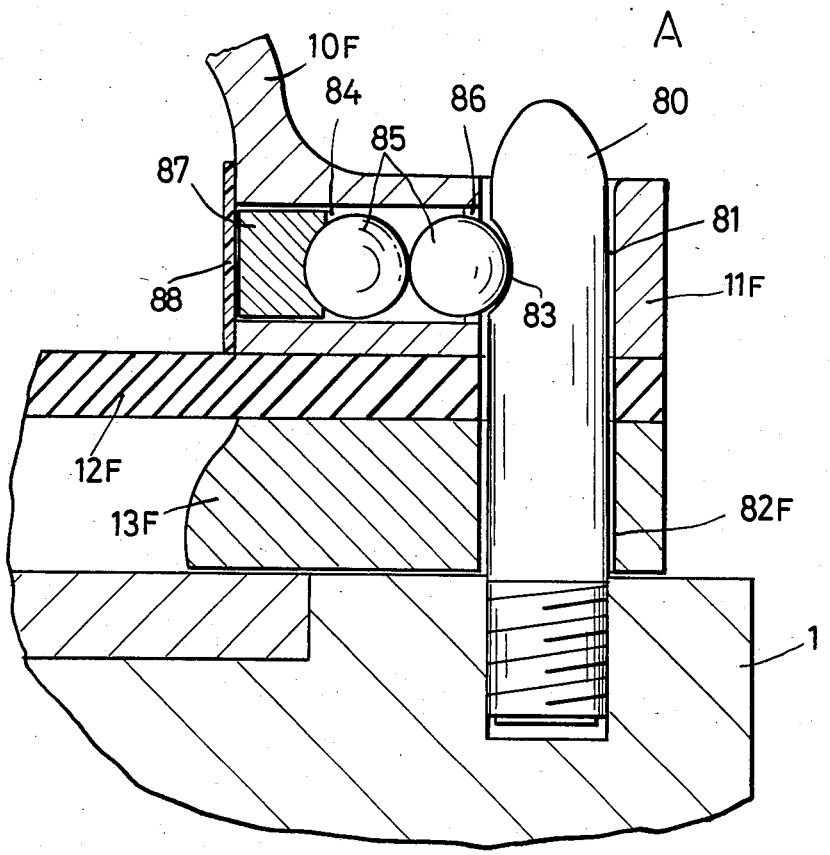
FIG. 7 is an enlarged vertical section showing a swing-up safety means suitable for bonding presses illustrated in FIGS. 1 to 4.

FIG. 7 shows another additional locking device which may be employed especially with the bonding presses shown in FIGS. 1 to 3. A pin 80 is mounted in the bed 1F for engagement in a corresponding opening 81, 82 when the pressing pad is closed, said opening 81, 82 being provided in alignment in the rim 11 of the cowl 10F and in the retaining ring 13F—and possibly also in the diaphragm 12F. The upper end of the retaining pin 80 is formed with a spherical recess 83. The enlarged annular flange 11F of the cowl rim is formed with a horizontally extending bore 84 having at least one ball 85 seated therein, said ball being held captive by a retainer 86. The end portion of the bore 84 facing towards the interior of the pressing pad accommodates an axially movable thrust piece 87 having one side thereof flush with the inner face of the cowl 10F, while the other surface may be spherical in conformity with the shape of the ball 85. The axially movable thrust piece 87 is sealed relative to the interior of the pressing pad, for instance by means of a rubber pad 88 cemented across the inner opening of the bore 84.

The device shown in FIG. 7 acts as a ball-type brake mechanism as long as there is an internal pressure within the pressing cowl. Said internal pressure acts through the rubber pad 88 and the thrust piece 87 on the balls and urges the same into the spherical recess 83 of the pin 80. As soon as the internal pressure has decreased below a predetermined level the cowl 10F may be swivelled upwards, when the balls 85 together with the thrust piece 87 will be forced away and the rubber pad 88 will be expanded.

The invention is not limited to the illustrated embodiments thereof. Especially, it is possible to interchange or combine individual parts of the described embodiments, for instance the various pressing pad constructions. This also applies to the additional locking means according to FIGS. 5 to 7 which may also have a modified structure as long as automatic operation in response to the internal pressure of the pressing pad is ensured. Finally, it is also possible to use the pressing pad constructions shown, in FIGS. 3 and 4 with the bonding presses illustrated in FIGS. 1 to 3 and 5 to 6, respectively.

I claim:

1. A bonding press for bonding shoe soles to lasted uppers, comprising a fixed bed structure including an exchangeable receptacle plate into a padded opening of which a lasted upper is inserted and fixed with a sole laid thereon and facing upwards, a pressing pad to which a pressurized medium may be applied, a dimensionally stable cowl of said pad being hingedly joined to said bed structure and hermetically sealed towards the bottom by a flexibly expandable diaphragm, and linear drive means for pivoting said pressing pad and engaging it at an upper bearing block of said cowl, characterized in that said linear drive means engage said bearing block of said cowl through an articulated lever mechanism including toggle levers which are straightened out when said cowl is closed, and that a locking device is provided for locking said cowl in the closed position thereof until the internal pressure after completion of a pressing operation has dropped to a sufficiently low level, and further characterized in that said articulated lever mechanism includes a swivel arm pivotally connected to one of said toggle levers, said swivel arm being pivoted with one end to said bearing block of said cowl and being supported by a stationary abutment when said pressing pad is closed and subjected to internal pressure, whereby said cowl is locked against opening forces.

2. A bonding press as claimed in claim 1, characterized in that said linear drive means in the form of a pneumatic cylinder is pivoted to a column secured to said bed structure behind a cowl hinge and is subjected only to compression loads.

3. A bonding press as claimed in claim 1, characterized in that said locking device is a locking mechanism operated by said pressing pad pressure.

4. A bonding press as claimed in claim 1, characterized in that said cowl comprises a solid rear part and a downwardly bent pivot projection constituting counterweights to the weight of said forward cowl part during an opening and closing movement, wherein said pivot projection is hinged to said bed structure beneath a receptacle plate.

5. A bonding press as claimed in claim 1, characterized in that a toggle lever of said articulated lever mechanism is pivoted to said bed structure beneath a receptacle plate, and that to the upper end of said lever, which extends beyond said cowl, a second toggle lever engaging said cowl and said linear drive means are pivotally connected.

6. A bonding press as claimed in claim 5, characterized in that said second toggle lever is constituted of two parallel members passing laterally beside said pressing pad and having their upper ends joined by a tie bar.

7. A bonding press for bonding shoe soles to lasted uppers, comprising a fixed bed structure including an exchangeable receptacle plate into a padded opening of which a lasted upper is inserted and fixed with a sole laid thereon and facing upwards, a pressing pad to which a pressurized medium may be applied, a dimensionally stable cowl of said pad being hingedly joined to said bed structure and hermetically sealed towards the bottom by a flexibly expandable diagphragm, and linear drive means for pivoting said pressing pad and engaging it at an upper bearing block of said cowl, characterized in that said linear drive means engage said bearing block of said cowl through an articulated lever mechanism including toggle levers which are straightened out when said cowl is closed, and that a locking device is provided for locking said cowl in the closed position thereof until the internal pressure after completion of a pressing operation has dropped to a sufficiently low level, and further characterized in that in the front portion of said bed structure an obliquely upwardly and rearwardly directed column is secured, which includes an abutment in the form of a tie bar for a swivel arm and a pivot bearing for one of said toggle levers.

8. A bonding press for bonding shoe soles to lasted uppers, comprising a fixed bed structure including an exchangeable receptacle plate into a padded opening of which a lasted upper is inserted and fixed with a sole laid thereon and facing upwards, a pressing pad to which a pressurized medium may be applied, a dimensionally stable cowl of said pad being hingedly joined to said bed structure and hermetically sealed towards the bottom by a flexibly expandable diaphragm, and linear drive means for pivoting said pressing pad and engaging at an upper bearing block of said cowl, characterized in that said linear drive means engage said bearing block of said cowl through an articulated lever mechanism including toggle levers which are straightened out when said cowl is closed, and that a locking device is provided for locking said cowl in the closed position thereof until the internal pressure after completion of a pressing operation has dropped to a sufficiently low level, further characterized in that said cowl is constituted of a light-weight cover and a solid frame which includes a bearing block for said articulated lever mechanism and a downwardly bent pivot projection, and further characterized in that a flexible, non-expandable intermediate diaphragm is hermetically retained between a peripheral flange of said light-weight cover part and said solid frame.

9. A bonding press as claimed in claim 8, characterized in that said solid frame and a clamping frame include annular grooves between which an outer edge of the diaphragm, which is formed with annular rings, is hermetically clamped.

10. A bonding press for bonding shoe soles to lasted uppers, comprising a fixed bed structure including an exchangeable receptacle plate into a padded opening of which a lasted upper is inserted and fixed with a sole laid thereon and facing upwards, a pressing pad to which a pressurized medium may be applied, a dimensionally stable cowl of said pad being hingedly joined to said bed structure and hermetically sealed towards the bottom by a flexibly expandable diaphragm, and linear drive means for pivoting said pressing pad and engaging it at an upper bearing block of said cowl, characterized in that said linear means engage said bearing block of said cowl through an articulated lever mechanism including toggle levers which are straightened out when said cowl is closed, and that a locking device is provided for locking said cowl in the closed position thereof until the internal pressure after completion of a pressing operation has dropped to a sufficiently low level, said bonding press characterized in that said cowl is constituted of a light-weight cover and a solid frame which includes a bearing block for said articulated lever mechanism and a downwardly bent pivot projection and further characterized in that a steel frame, which is fixedly joined to said bearing block, at its upper end portion includes stop abutments which engage over the edge of said light-weight cover part, and that the lower end portion of said steel frame is provided with clamping means for pressure-tight attachment of said flexible diaphragm and of a lower clamping frame, said attachment being adapted to be released from the underside of said pressing pad.

11. A bonding press as claimed in claim 10, characterized in that said light-weight cover part has an enlarged rim, the height of said rim approximately corresponding to that of an intermediate frame.

12. A bonding press as claimed in claim 10, characterized in that a quick-clamping mechanism is provided for clamping said cover part to said lower clamping frame, said mechanism including clamping pads and clamping bolts inserted in undercut recesses in said clamping frame and accessible from the side of the contact of said pressing pad, nuts thereof being seated in radial bores of said steel frame.

13. A bonding press as claimed in claim 10, characterized in that said light-weight inner cover part is made either of a light metal or of reinforced plastics.

* * * * *

UNITED STATES PATENT AND TRADEMARK OFFICE

CERTIFICATE OF CORRECTION

PATENT NO. : 4,628,559 Sheet 1 of 2

DATED : December 16, 1986

INVENTOR(S) : Herbert Funck

It is certified that error appears in the above-identified patent and that said Letters Patent is hereby corrected as shown below:

| | | |
|---|---|---|
| Column 2, | line 12, | "receiptacle" should read --receptacle-- |
| | line 65, | "rubber. diaphragm" should read --rubber diaphragm-- |
| Column 4, | line 30, | "swivel are" should read --swivel arm-- |
| Column 6, | line 68, | "projection 5" should read --projection 5A-- |
| Column 8, | line 30, | "12B and 50B" should read --12C and 50C-- |
| Column 9, | line 56, | "16D the" should read --16D of the-- |
| Column 10, | line 57, | "as long there" should read --as long as there-- |
| Column 12, | line 10, | "shown," should read --shown-- |

UNITED STATES PATENT AND TRADEMARK OFFICE

CERTIFICATE OF CORRECTION

PATENT NO. : 4,628,559 Sheet 2 of 2

DATED : December 16, 1986

INVENTOR(S) : Herbert Funck

It is certified that error appears in the above-identified patent and that said Letters Patent is hereby corrected as shown below:

Column 13, line 13, "diagphragm," should read --diaphragm,--

Column 13, line 43, "engaging at" should read --engaging it at--

Signed and Sealed this

Thirty-first Day of May, 1988

*Attest:*

DONALD J. QUIGG

*Attesting Officer*

*Commissioner of Patents and Trademarks*